United States Patent [19]

Hill

[11] Patent Number: 4,506,487

[45] Date of Patent: Mar. 26, 1985

[54] STEEL TRUSS

[76] Inventor: Arne Hill, Malmgårdsvägen 32, S-116 38 Stockholm, Sweden

[21] Appl. No.: 473,959

[22] Filed: Mar. 10, 1983

[51] Int. Cl.[3] ..... E04C 3/02

[52] U.S. Cl. ..... 52/690; 52/693; 403/11

[58] Field of Search ..... 52/690, 691, 692, 693, 52/695, 696, 634, 635, 636, 654, 655; 182/178, 179; 29/155 R; 228/182; 403/11; 14/4, 14

[56] References Cited

U.S. PATENT DOCUMENTS

| | | | |
|---|---|---|---|
| D. 227,086 | 6/1973 | Johnson | 52/695 |
| 515,445 | 2/1894 | Prasil | 14/14 |
| 1,901,800 | 3/1933 | Bushey | 52/695 |
| 3,050,831 | 8/1962 | Diamond | 52/636 |
| 3,570,204 | 3/1971 | Bikemier | 52/693 |
| 3,827,117 | 8/1974 | Ollman | 228/182 |
| 4,286,721 | 9/1981 | Ashworth | 182/2 |
| 4,335,556 | 6/1982 | Arnold | 52/694 |

FOREIGN PATENT DOCUMENTS

| | | | |
|---|---|---|---|
| 423926 | 2/1935 | United Kingdom | 14/14 |

*Primary Examiner*—John E. Murtagh
*Assistant Examiner*—Andrew Joseph Rudy
*Attorney, Agent, or Firm*—Fred Philpitt

[57] ABSTRACT

In a steel truss an upper longitudinal beam and a lower longitudinal beam are interconnected at their respective ends by vertical posts, and between their ends by a plurality of mutually intersecting, obliquely extending struts and ties only. Each end post is composed of two parts of substantially equal lengths, which are interconnectable end to end, and each strut and tie is composed of two parts, which are interconnectable at the intersection between them, whereby the truss may be factory-made in sections of moderate size for convenient transportation to the building site, where the assembly of the same requires only a minimum of work.

5 Claims, 9 Drawing Figures

STEEL TRUSS

BACKGROUND OF THE INVENTION

In the erection of certain kinds of buildings, such as hangars and halls, as well as in the erection of bridges there is a frequent need for steel trusses capable of spanning considerable distances and/or of supporting heavy loads. In many cases, especially in buildings, it is desirable or even necessary to design such steel trusses as generally rectangular frames including a pair of generally horizontally extending, longitudinal beams, an upper one and a lower one, which are interconnected at their respective ends by vertical posts and between their ends by a plurality of struts, i.e. members in compression, and ties, i.e. members in tension.

In order to combine maximum strength with minimum weight in the completed truss, the various members thereof must be joined together with great care and accuracy in a pattern, in which they interact as efficiently as possible in a manner to give mutual support and thus prevent distortion of the truss under the expected load. Experience has shown that the most economic and safe way of achieving this is to complete the entire truss in a factory and to transport it as a unit to the building site, where it is needed.

When there is a need for trusses, the spans of which exceed about 25 meters, it is common practice to divide them into shorter sections, which can be completed as separate units in the factory and then conveniently joined together end to end at the building site, such as by welding, riveting or bolting. This facilitates transportation and still leaves only a minor part of the assembly work to be carried out at the building site, as is desirable.

However, when the span of the truss and/or the load to be supported thereby are of such magnitudes that it will be necessary to use a truss height, i.e. the distance between the upper and lower horizontal members, exceeding about 4 meters, severe transportation problems are likely to arise, in particular when the transports have to be carried out by trucks on public roads or highways. These problems are frequently extremely expensive to overcome, if at all possible to solve, unless the truss can be divided into factory-made sections having not only a moderate length but also a height, which is sufficiently small to let the truss-loaded vehicle pass ordinary road obstructions, such as underpasses, bridges and the like, with acceptable clearance.

BRIEF SUMMARY OF THE INVENTION

It is a main object of this invention to provide a truss of the kind defined hereinbefore, which in spite of having a considerable height when completed can be factory-made in sections, the heights of which are moderate enough to cause no severe transportation problems, but which nevertheless are of sufficient size to reduce the assembly work on the building site to a minimum.

Further objects of the invention are to minimize the number of connections to be established between such truss sections on the building site, to make the accomplishment of the necessary connections as simple and convenient as possible, and to avoid excessive use of material in preparing the truss sections.

According to the invention these objects are basically achieved by using between the two vertical end posts of the truss frame a fairly unconventional arrangement of intersecting, obliquely extending struts and ties only for interconnecting the upper and lower truss beams, by composing each of said two vertical end posts of two parts of substantially equal lengths which are conveniently interconnectable end to end, and by composing each of said struts and ties of two parts which are conveniently interconnectable at their mutual intersection. Preferably, each strut part then has its intersection end joined to the corresponding end of a related tie part extending from the same truss beam.

Further objects and features of the invention will become apparent from the following description of a preferred embodiment thereof, in which reference is had to the accompanying drawings.

IN THE DRAWINGS

FIG. 1 is a somewhat simplified side view of a truss embodying the invention, FIG. 2 is a side view similar to that in FIG. 1 but showing the various sections of the truss in separated or "exploded" positions, FIG. 3 is an enlarged cross-sectional view taken on line III—III of FIG. 1, FIG. 4 is an enlargement of the area IV in FIG. 1 showing a welded joint in the upper horizontal truss beam, FIG. 5 is an enlarged sectional elevation taken within the area V in FIG. 1 and showing a welded joint in the lower horizontal truss beam, FIG. 6 is an enlarged cross-sectional view taken on line VI—VI of FIG. 1, FIG. 7 is a fragmentary side view on an enlarged scale showing intersecting parts of one of the struts and one of the ties of the truss before being joined together, FIG. 8 is a fragmentary side view on an enlarged scale showing the completed intersection joint, and FIG. 9 is a cross-sectional view taken on line IX—IX of FIG. 8.

DESCRIPTION OF THE PREFERRED EMBODIMENT

Figure 1:
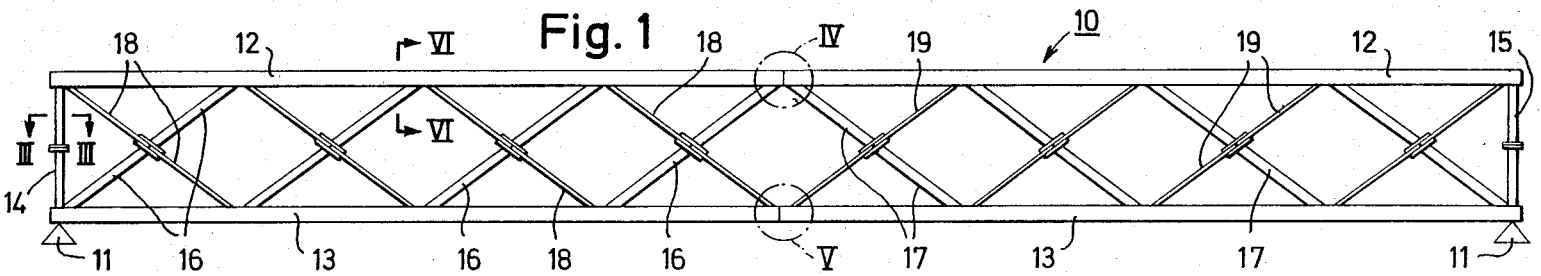

In FIG. 1 of the drawings a truss 10 embodying the invention is shown resting on two diagrammatically illustrated supports 11 and spanning the distance therebetween. For the purpose of illustration only, it is assumed that the truss 10 has to support a vertical load, which is evenly distributed along the full length thereof. Any person skilled in the art of truss design will readily understand how to modify the structure, if the truss is to be used for supporting other kinds of loads.

The truss 10 comprises an upper longitudinal steel beam 12, which in the case illustrated will be subjected to compression, and a lower longitudinal steel beam 13, which in the case illustrated will be subjected to tension. These two beams 12 and 13 extend generally horizontally along the full length of the truss and are interconnected at their respective ends by vertical steel posts 14 and 15 so as to form with the latter a generally rectangular frame. In the opening of this frame there are provided a plurality of struts 16, 17 and ties 18, 19 of equal lengths, and these truss members are also made of steel. All the struts and ties extend obliquely between the upper and lower beams 12 and 13, and each strut intersects a related tie substantially midway between said beams. The struts 16 and 17 are members in compression, whereas the ties 18 and 19 are members in tension.

It is to be noted that the two end posts 14 and 15 are the only vertical members in the entire truss structure.

Figure 2:
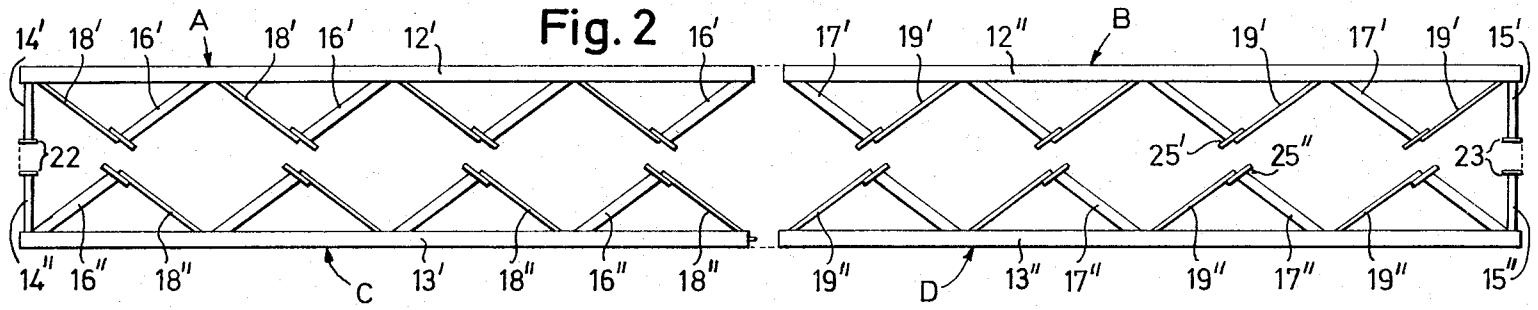

As illustrated in FIG. 2, the truss 10 of FIG. 1 is actually composed of four factory-prepared sections A, B, C and D, which are sufficiently small in size to permit easy transportation from the factory to the building site but also large enough to reduce the assembly work at the building site to a minimum. It should be understood that before leaving the factory the sections should ordinarily be tested to fit properly together by being first provisionally assembled and then again disassembled for transportation.

More specifically, section A comprises a first part 12' of the upper longitudinal beam 12, an upper part 14' of the vertical end post 14, upper parts 16' of the struts 16, and upper parts 18' of the ties 18. Similarly, section B comprises a second part 12" of the upper longitudinal beam 12, an upper part 15' of the vertical end post 15, upper parts 17' of the struts 17, and upper parts 19' of the ties 19. On the other hand, section C comprises a first part 13' of the lower longitudinal beam 13, a lower part 14" of the vertical end post 14, lower parts 16" of the struts 16, and lower parts 18" of the ties 18. Finally, section D comprises a second part 13" of the lower longitudinal beam 13, a lower part 15" of the vertical end post 15, lower parts 17" of the struts 17, and lower parts 19" of the ties 19.

In the example shown the two longitudinal beams 12 and 13 have generally H-shaped cross sections. However, any person skilled in the art will readily understand that any kinds of beams or tubes having sufficient strength for the purpose may equally well be used, and that the cross section or the cross sectional size of the longitudinal beams may vary along the lengths thereof, if so desired. Also the vertical end posts 14 and 15 are shown to have an H-shaped cross section, although they may just as well have an I-shaped or tubular cross section, if so desired. The struts 16 and 17 are shown to have a generally I-shaped cross section but, as an alternative not shown, they may be tubular or have any other suitable cross section assuring a high resistance to buckling. On the other hand, the ties 18 and 19 are simply made of broad flats, which has proved to be quite satisfactory, as the ties are subjected to no buckling load, and which brings about several advantages.

Figure 5:
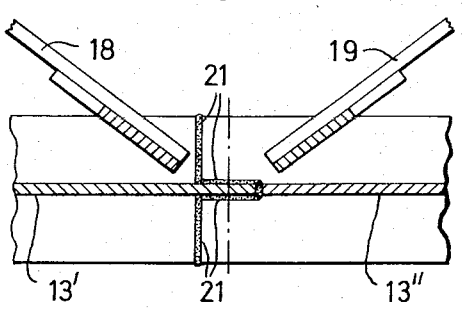
Figure 4:
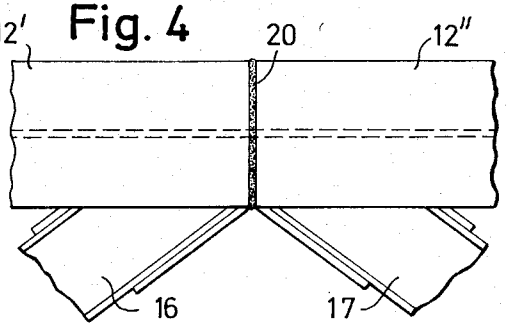

How the two parts 12' and 12" of the upper longitudinal beam 12 are joined together, when the two sections A and B are assembled at the building site, is of no particular importance as far as the invention is concerned, but the joint must, of course, be given the necessary strength. Bolting or riveting in a conventional fashion may be successfully used, but butt welding as shown at 20 in FIG. 4 is commonly preferred. Similarly, when the two sections C and D are assembled, the two parts 13' and 13" of the lower longitudinal beam 13 may be joined by bolting or riveting, although in the example shown in FIG. 5 they have been welded together as at 21 in a manner to make the joint capable of taking up the occurring tensile stress.

Figure 3:
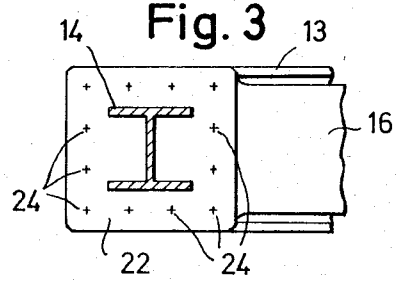

The upper and lower parts 14' and 14" of the vertical end post 14 as well as the upper and lower parts 15' and 15" of the vertical end post 15 have their free ends provided with mating end flanges 22, and 23 respectively, which are adapted to be interconnected by means of bolts or rivets 24 as indicated in FIG. 3. The joint thus formed in each end post 14 and 15 is in a position approximately midway between the two beams 12 and 13.

As can be clearly seen from FIG. 2 the struts 16, 17 as well as the ties 18, 19 are all divided into two parts of equal lengths. In the upper truss section A each strut part 16' has its lower intersection end connected to the lower end of its related tie part 18' so as to form with said tie part and with the upper beam part 12' a triangle having a downwardly directed top, which is to be secured to the upwardly directed top of a corresponding triangle formed in the lower truss section C by the remaining part 16" of the same strut 16 and the remaining part 18" of the same tie 18 together with the lower beam part 13'. Similarly, in the upper truss section B, each strut part 17' has its lower intersection end connected to the lower end of its related tie part 19' so as to form with said tie part and with the upper beam part 12" a triangle having a downwardly directed top, which is to be secured to the upwardly directed top of a corresponding triangle formed in the lower truss section D by the remaining part 17" of the same strut 17 and the remaining part 19" of the same tie 19 together with the lower beam part 13".

Accordingly, there is no need for separate joints in each of the struts 16, 17 and in each of the ties 18, 19, which means that the number of joints to be made at the building site in order to assemble the truss sections is reduced to a minimum.

Figure 8:
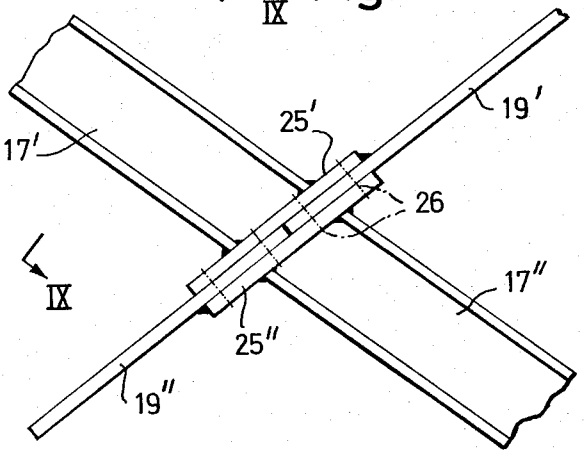
Figure 6:
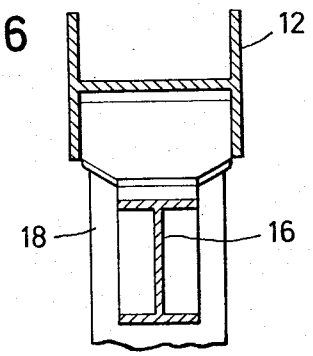
Figure 7:
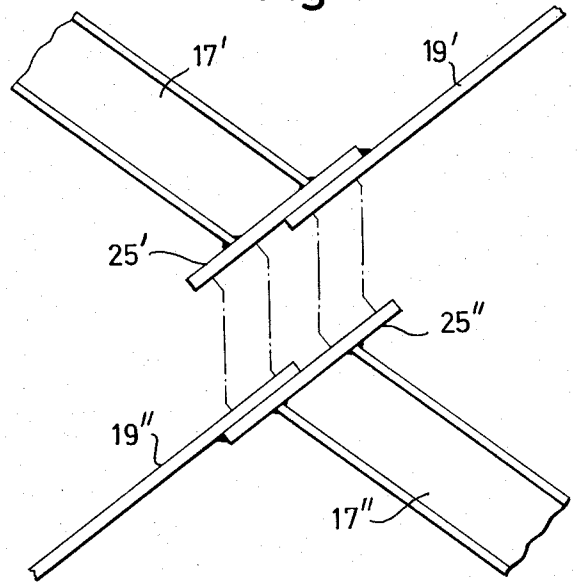
Figure 9:
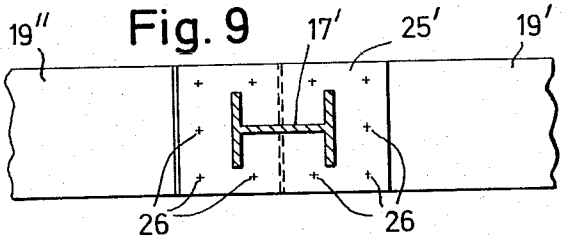

As can be seen from FIG. 7 each upper part 17' of each strut 17 has its lower end welded to a connection plate 25', to the free face of which the lower end portion of the upper part 19' of the related tie 19 is attached, such as by welding, in a position to cover only half the connection plate. Similarly, the lower part 17" of the strut 17 has its upper end welded to a connection plate 25", to the free face of which the upper end portion of the lower part 19" of the related tie 19 is attached in a manner to cover only half the connection plate 25". The two connection plates 25' and 25" are parallel with one another and with the flats forming the tie parts 19' and 19". When the truss sections B and D have been put together as shown in FIG. 8, the two connection plates may be easily and reliably connected together by passing a number of bolts or rivets 26 through both the two plates and through the flats 19' and 19" between them in a suitable pattern, such as the one illustrated in FIG. 9. Thus the connection plates 25' and 25" serve as a kind of splice plates for the tie parts 19' and 19" in the completed joint.

The parts of the struts 16 and the ties 18 included in the two truss sections A and C are joined in the same manner.

It is to be understood that in a truss according to the invention the joints in the upper and lower longitudinal beams may be omitted, if the total length of the truss is short enough to cause no transportation problem, and that the number of such joints may be increased, if the total length of the truss is extreme. Of course, the beam joints should always be arranged straight above one another and at points where they do not interfere with the struts or ties.

Although it is preferred to join the various members included in each truss section by welding, bolting or riveting may be resorted to, if desired.

I claim:

1. A completed steel truss which is composed of prefabricated, longitudinally extending truss sections, said truss sections each having a height which is approximately only half the height of the completed steel truss and the completed steel truss comprises an upper longitudinal beam, a lower longitudinal beam, and a plurality of straight ties and struts that interconnect said upper and lower beams to thereby form a lattice within the plane defined by said upper and lower beams, said ties and struts being obliquely arranged with respect to each other so that each tie will intersect an associated strut at a point approximately midway between said upper and lower beams, wherein (a) each of said ties and struts is composed of an upper part secured to and extending obliquely downwardly from said upper beam and a lower part secured to and extending obliquely upwardly from said lower beam, said upper and lower parts of associated ties and struts meeting and being united in a common joint, and wherein in each common joint (b) said upper and lower tie parts have flat end portions of equal thicknesses lying approximately end-to-end in a common plane forming a right angle to the plane between said upper and lower beams, and (c) said upper and lower strut parts have their respective ends secured approximately to the center of each one of two opposite connection plates of generally equal size lying in planes parallel to said flat end portions of said associated tie parts and having said flat end portions interposed and retained between them, each prefabricated truss section comprising one of said two longitudinal beams and the tie and strut parts secured thereto, and said connection plates in each joint serving as splice plates for the tie parts of the respective truss sections when the tie parts and strut parts are joined together.

2. A steel truss as claimed in claim 1 wherein in each of said prefabricated truss sections the flat end portion of each tie part is secured to a free face of the connection plate of its associated strut part in a manner to cover approximately half said face, so that each tie part and its associated strut part together with a portion of the beam to which they are connected will form a rigid, open triangle.

3. A steel truss as claimed in claim 1 wherein said two connection plates and said two flat end portions of the meeting tie parts in each joint have mutually registering holes for through-passing bolts or rivets.

4. A steel truss as claimed in claim 1 wherein said tie parts throughout their lengths are made of flats, the planes of which form a right angle to the plane of said lattice, and wherein each connection plate has a width substantially corresponding to widths of said tie parts.

5. A steel truss as claimed in claim 1 wherein said upper and lower beams at their respective ends are additionally interconnected by vertically extending end posts, each such end post being composed of two parts, an upper one secured to and extending downwardly from said upper beam and a lower one secured to and extending upwardly from said lower beam, said post parts having substantially equal lengths and being adapted to be interconnected end to end.

* * * * *